US011742573B2

(12) United States Patent
Lu et al.

(10) Patent No.: US 11,742,573 B2
(45) Date of Patent: Aug. 29, 2023

(54) ANTENNA DEVICE AND ORIENTATION ADJUSTMENT MECHANISM

(71) Applicant: WISTRON NEWEB CORPORATION, Hsinchu (TW)

(72) Inventors: Man-Ning Lu, Hsinchu (TW); Ming-Hung Hung, Hsinchu (TW); Yu-Kai Chiu, Hsinchu (TW)

(73) Assignee: WISTRON NEWEB CORPORATION, Hsinchu (TW)

( * ) Notice: Subject to any disclaimer, the term of this patent is extended or adjusted under 35 U.S.C. 154(b) by 42 days.

(21) Appl. No.: 17/700,567

(22) Filed: Mar. 22, 2022

(65) Prior Publication Data

US 2023/0103961 A1 Apr. 6, 2023

(30) Foreign Application Priority Data

Oct. 1, 2021 (TW) ..... 110136634

(51) Int. Cl.
*H01Q 3/06* (2006.01)

(52) U.S. Cl.
CPC ..... *H01Q 3/06* (2013.01)

(58) Field of Classification Search
CPC ..... H01Q 1/12; H01Q 1/125; H01Q 1/1257; H01Q 1/1264; H01Q 3/02; H01Q 3/04; H01Q 3/06
See application file for complete search history.

(56) References Cited

U.S. PATENT DOCUMENTS

2012/0157006 A1* 6/2012 Hong ..... H01Q 1/2225 455/67.14

FOREIGN PATENT DOCUMENTS

CN 115565466 A * 1/2023
TW 201609475 A 3/2016
WO WO-2006031708 A2 * 3/2006 ..... H01Q 1/081

* cited by examiner

*Primary Examiner* — Daniel Munoz
(74) *Attorney, Agent, or Firm* — McClure, Qualey & Rodack, LLP

(57) ABSTRACT

An antenna device and an orientation adjustment mechanism are provided. The orientation adjustment mechanism includes a holder, a rotation carrier assembled to the holder, and a torsion spring. The rotation carrier is counterclockwise rotatable from an initial position by a first predetermined angle or is clockwise rotatable from the initial position by a second predetermined angle. The torsion spring has an elastic portion disposed on the holder and two extending arms that extend from the elastic portion. When the rotation carrier is rotated from the initial position by the first predetermined angle or the second predetermined angle, the rotation carrier presses and moves one of the two extending arms, and another one of the two extending arms abuts against the limiting portion, so that the elastic portion is deformed to store an elastic force that tends to move the rotation carrier toward the initial position.

14 Claims, 15 Drawing Sheets

ANTENNA DEVICE AND ORIENTATION ADJUSTMENT MECHANISM

CROSS-REFERENCE TO RELATED PATENT APPLICATION

This application claims the benefit of priority to Taiwan Patent Application No. 110136634, filed on Oct. 1, 2021. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to an adjustment mechanism, and more particularly to an antenna device and an orientation adjustment mechanism.

BACKGROUND OF THE DISCLOSURE

An antenna board of a conventional antenna device has a predetermined signal directivity and a predetermined signal coverage angle, so that after the conventional antenna device is disposed at a specific position, the conventional antenna device has a limited applicability and cannot be dynamically adjusted according to a surrounding environment thereof.

SUMMARY OF THE DISCLOSURE

In response to the above-referenced technical inadequacy, the present disclosure provides an antenna device and an orientation adjustment mechanism to effectively improve on the issues associated with conventional antenna devices.

In one aspect, the present disclosure provides an antenna device, which includes an orientation adjustment mechanism, an antenna board, and a driving module. The orientation adjustment mechanism includes a holder, a rotation carrier, and a torsion spring. The holder has a limiting portion. The rotation carrier is assembled to the holder and is rotatable along a rotation axis relative to the holder. The rotation carrier is rotatable in a counterclockwise direction from an initial position by a first predetermined angle to be retained at a first position or is rotatable in a clockwise direction from the initial position by a second predetermined angle to be retained at a second position. The torsion spring has an elastic portion disposed on the holder and two extending arms that extend from the elastic portion. When the rotation carrier is rotated from the initial position by the first predetermined angle or the second predetermined angle, the rotation carrier presses and moves one of the two extending arms, and another one of the two extending arms abuts against the limiting portion, so that the elastic portion is deformed to store an elastic force that tends to move the rotation carrier to the initial position. The antenna board is assembled to the rotation carrier and is non-perpendicular to the rotation axis. The driving module corresponds in position to the rotation carrier and is configured to drive the rotation carrier to be rotated.

In another aspect, the present disclosure provides an orientation adjustment mechanism, which includes a holder, a rotation carrier, and a torsion spring. The holder has a limiting portion. The rotation carrier is assembled to the holder and is rotatable along a rotation axis relative to the holder. The rotation carrier is rotatable in a counterclockwise direction from an initial position by a first predetermined angle to be retained at a first position or is rotatable in a clockwise direction from the initial position by a second predetermined angle to be retained at a second position. The torsion spring has an elastic portion disposed on the holder and two extending arms that extend from the elastic portion. When the rotation carrier is rotated from the initial position by the first predetermined angle or the second predetermined angle, the rotation carrier presses and moves one of the two extending arms, and another one of the two extending arms abuts against the limiting portion, so that the elastic portion is deformed to store an elastic force that tends to move the rotation carrier toward the initial position.

Therefore, in the antenna device provided by the present disclosure, the antenna board can be rotated with the rotation carrier to different positions through the orientation adjustment mechanism, so that a main beam direction of the antenna board can be changed or adjusted in the antenna device. Accordingly, the antenna device of the present disclosure can satisfy broader use requirements (e.g., the antenna device can be avoided reducing the applicability after being fastened at a specific position) and can be applied to more different environments.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
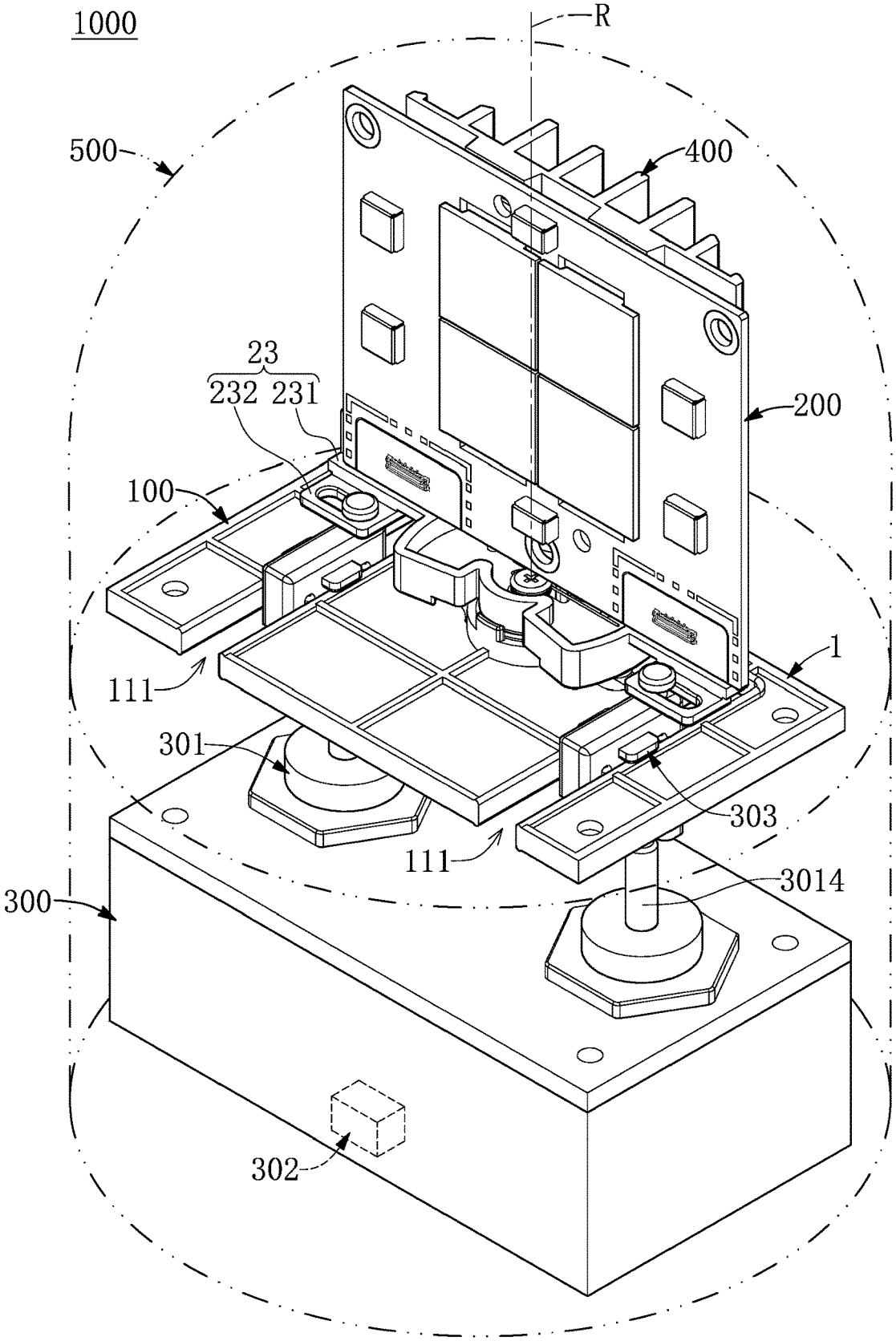
FIG. 1 is a perspective view of an antenna device according to an embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Referring to FIG. 1 to FIG. 13, which show an embodiment of the present disclosure. As shown in FIG. 1 to FIG. 4, the present embodiment provides an antenna device 1000 for being used to transmit 5G signals or high directivity signals (e.g., micro-wave signals), but the present disclosure is not limited thereto. In the present embodiment, the antenna device 1000 includes an orientation adjustment mechanism 100, an antenna board 200 assembled to the orientation adjustment mechanism 100, a driving module 300 configured to drive the orientation adjustment mechanism 100 to rotate the antenna board 200, a heatsink 400 assembled to the antenna board 200, and a housing 500.

The orientation adjustment mechanism 100, the antenna board 200, the driving module 300, and the heatsink 400 are arranged in the housing 500. In other words, the antenna device 1000 in the present embodiment is provided by improving interior structure thereof, so that the antenna device 1000 of the present embodiment is different from an antenna device that is provided by carrying any adjustment mechanism on an outer side thereof.

It should be noted that the orientation adjustment mechanism 100 in the present embodiment is described in cooperation with the antenna board 200, the driving module 300, the heatsink 400, and the housing 500, but the present disclosure is not limited thereto. For example, in other embodiments of the present disclosure not shown in the drawings, the antenna device 1000 can be provided without at least one of the heatsink 400 and the housing 500; or, the orientation adjustment mechanism 100 can be independently used (e.g., sold) or can be used in cooperation with other components. The following description describes the structure and the connection relationship of each component of the antenna device 1000.

Figure 5:
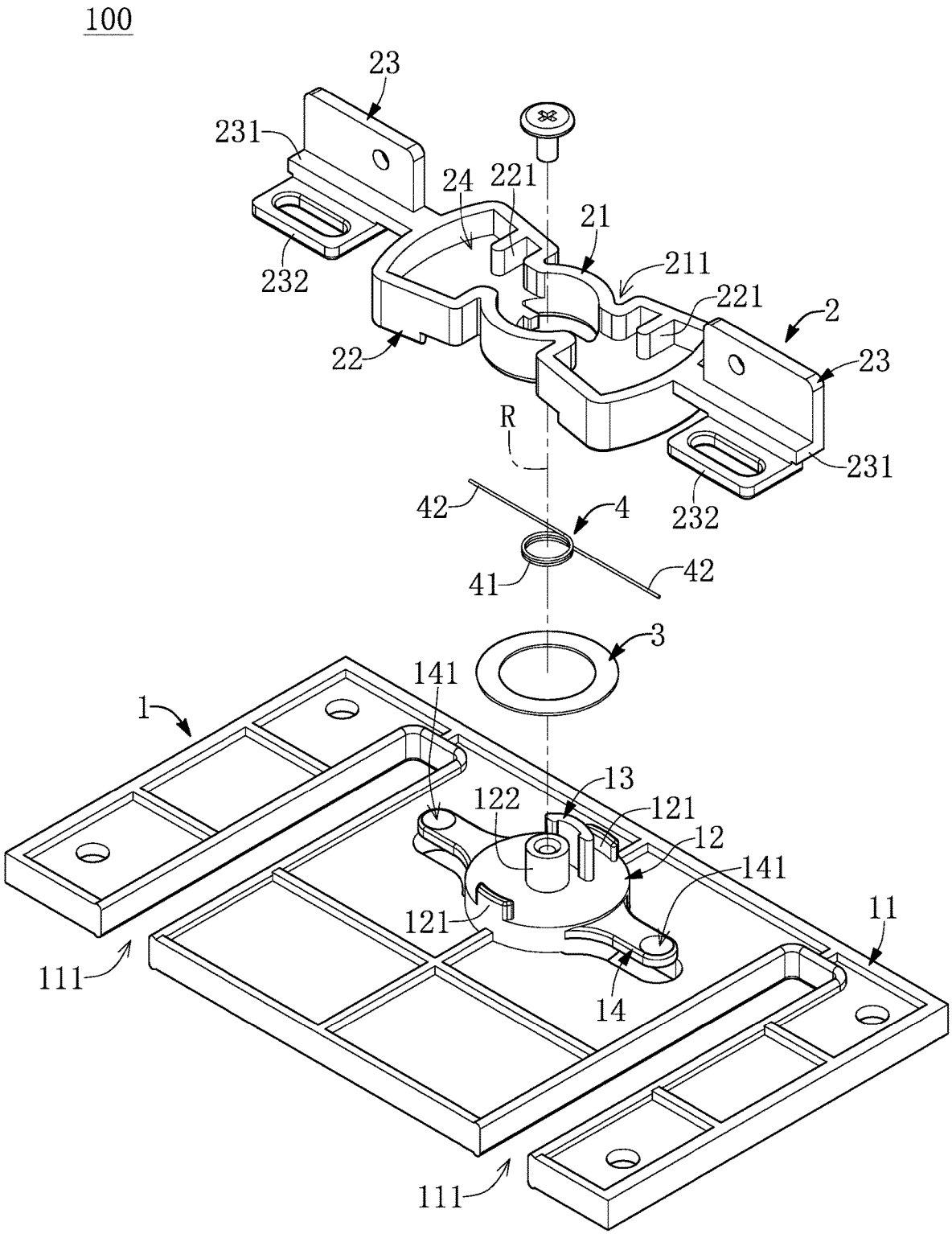
FIG. 5 is an exploded view showing an orientation adjustment mechanism of FIG. 4.
Figure 6:
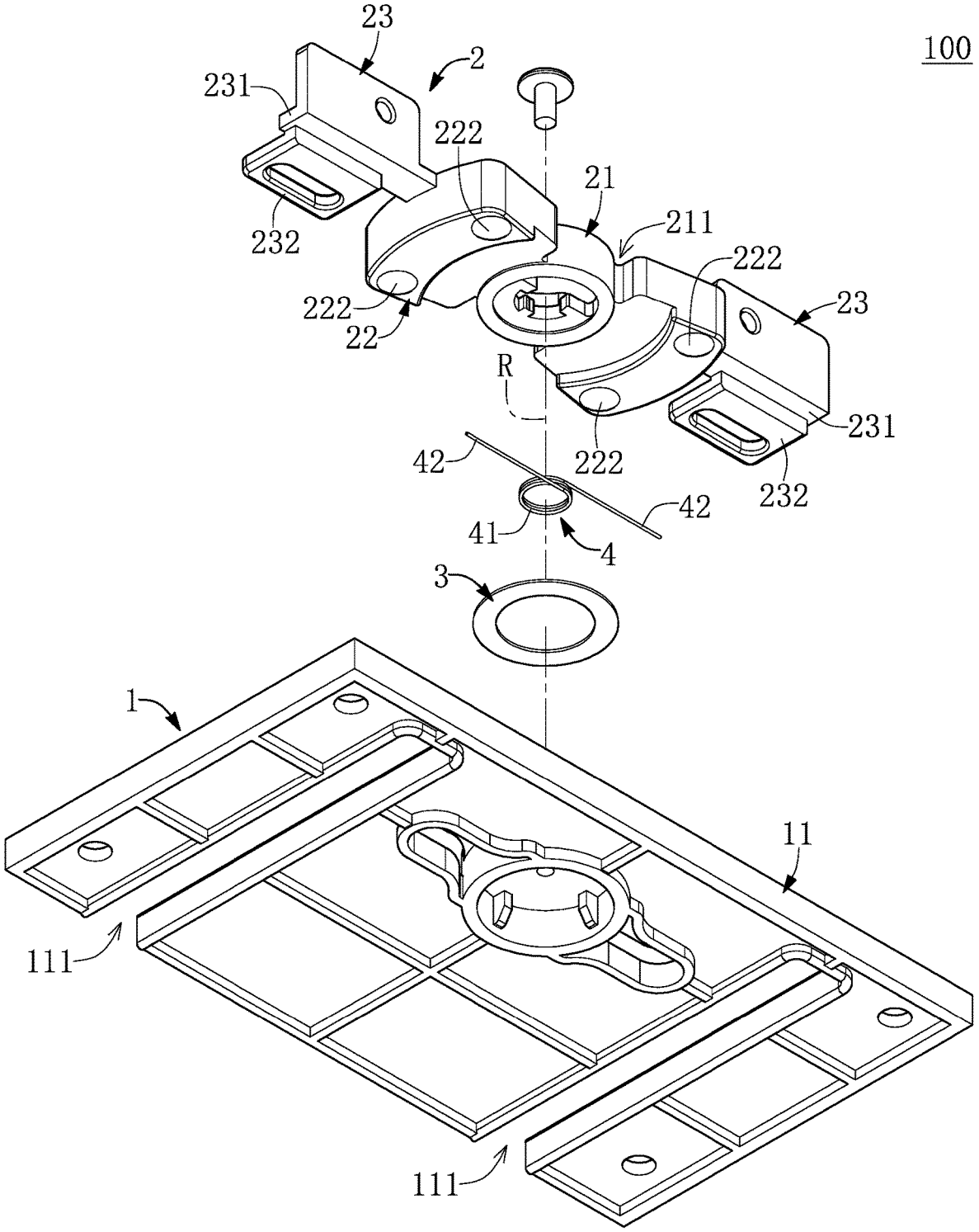
FIG. 6 is an exploded view showing the orientation adjustment mechanism of FIG. 4 from another angle of view.
Figure 7:
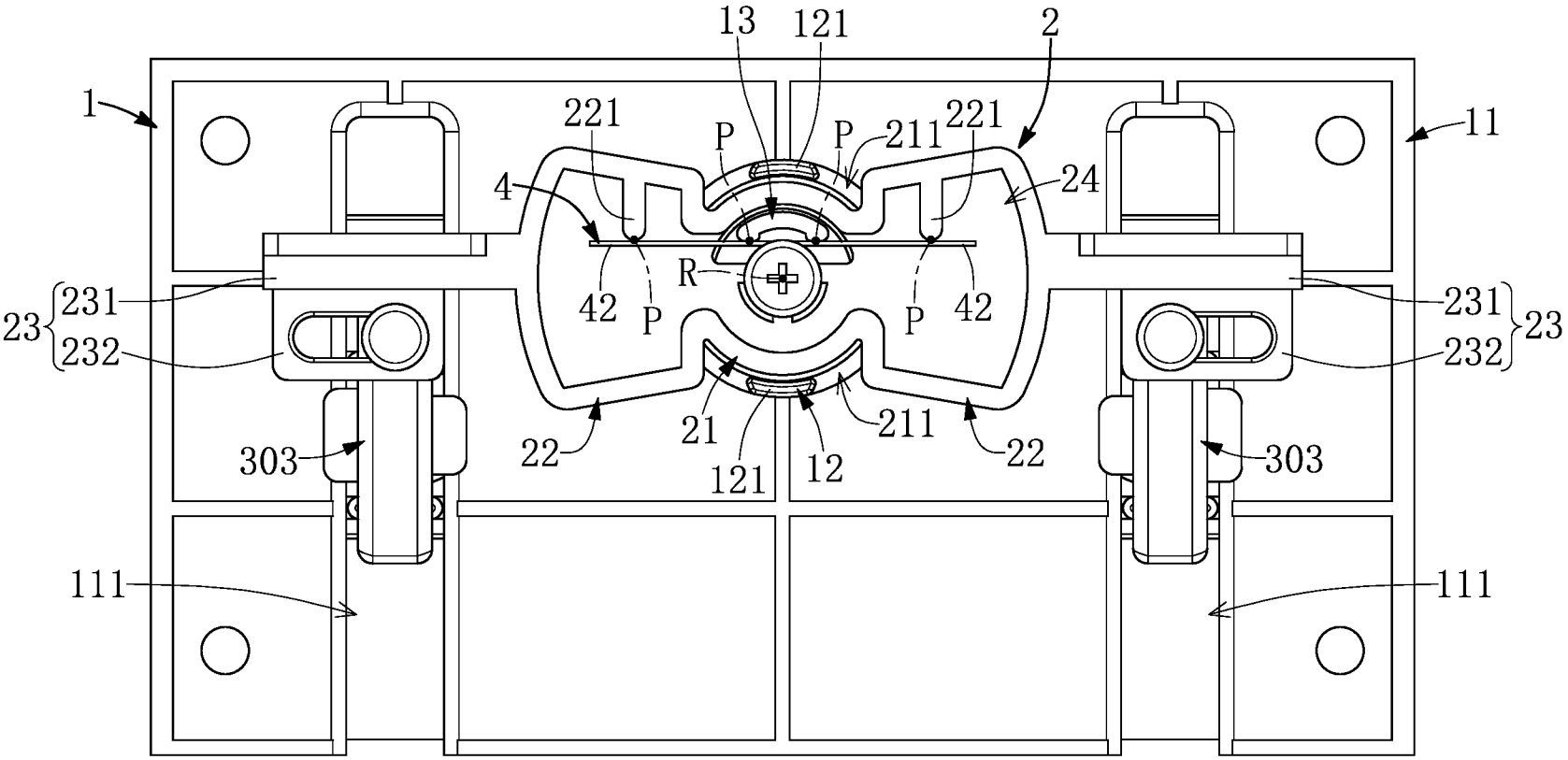
FIG. 7 is a top view of FIG. 1 when an antenna board, a heatsink, and a housing are omitted.

As shown in FIG. 5 to FIG. 7, the orientation adjustment mechanism 100 includes a holder 1, a rotation carrier 2 assembled to the holder 1, a gasket 3 sandwiched between the holder 1 and the rotation carrier 2, a torsion spring 4 that is connected to the holder 1 and the rotation carrier 2. It should be noted that specific structure of each of the holder 1, the rotation carrier 2, the gasket 3, and the torsion spring 4 can be changed or adjusted according to design requirements. In order to clearly describe the present embodiment, the following description just describes the orientation adjustment mechanism 100 in one possible structure.

In the present embodiment, the holder 1 is an inherently one-piece structure, and includes a board 11, a stage 12 connected to the board 11, a limiting portion 13 upright connected to the stage 12, and two cantilevers 14 that extend from the stage 12 along directions away from each other, respectively.

Specifically, the board 11 has two track grooves 111 that are recessed from an edge thereof and that are parallel to each other. The stage 12 is substantially in a cylindrical shape and is arranged between the two track grooves 111. The stage 12 has two protruding sheets 121 arranged on a top side thereof and an assembling pillar 122 arranged on a center thereof. A central line of the assembling pillar 122 in the present embodiment is defined as a rotation axis R. In addition, the gasket 3 is disposed on the stage 12 and surrounds an outer side of the assembling pillar 122, and the gasket 3 is held between the two protruding sheets 121.

Moreover, the limiting portion 13 is arranged between the assembling pillar 122 and one of the two protruding sheets 121, the limiting portion 13 is substantially in an arced shape having a center of circle that is located at the rotation axis R, and the limiting portion 13 has a central angle, that is less than 180 degrees, with respect to the rotation axis R, but the present disclosure is not limited thereto. Preferably, the central angle is within a range from 70 degrees to 90 degrees.

The two cantilevers 14 extend from lateral surfaces of the stage 12 toward the two track grooves 111, respectively. Each of the two cantilevers 14 is preferably perpendicular to one of the track grooves 111 adjacent thereto, and is perpendicular to an arrangement direction of the two protruding sheets 121. Each of the two cantilevers 14 has a positioning portion 141 (e.g., a slot) arranged on a free end thereof, but the present disclosure is not limited thereto.

For example, in other embodiments of the present disclosure not shown in the drawings, the holder 1 can be provided without the two cantilevers 14 or the two positioning portions 141; or, each of the two positioning portions 141 of the holder 1 is directly formed on the board 11, and a quantity of the positioning portions 141 of the holder 1 can be at least one.

The rotation carrier 2 is pivotally connected to the holder 1 along the rotation axis R, that is to say, the rotation carrier 2 is rotatable along the rotation axis R relative to the holder 1. Specifically, the rotation carrier 2 is rotatable in a counterclockwise direction from an initial position (shown in FIG. 7) by a first predetermined angle $\alpha 1$ to be retained at a first position (shown in FIG. 8A) or is rotatable in a clockwise direction from the initial position by a second predetermined angle $\alpha 2$ to be retained at a second position (shown in FIG. 9A).

Figure 8A:
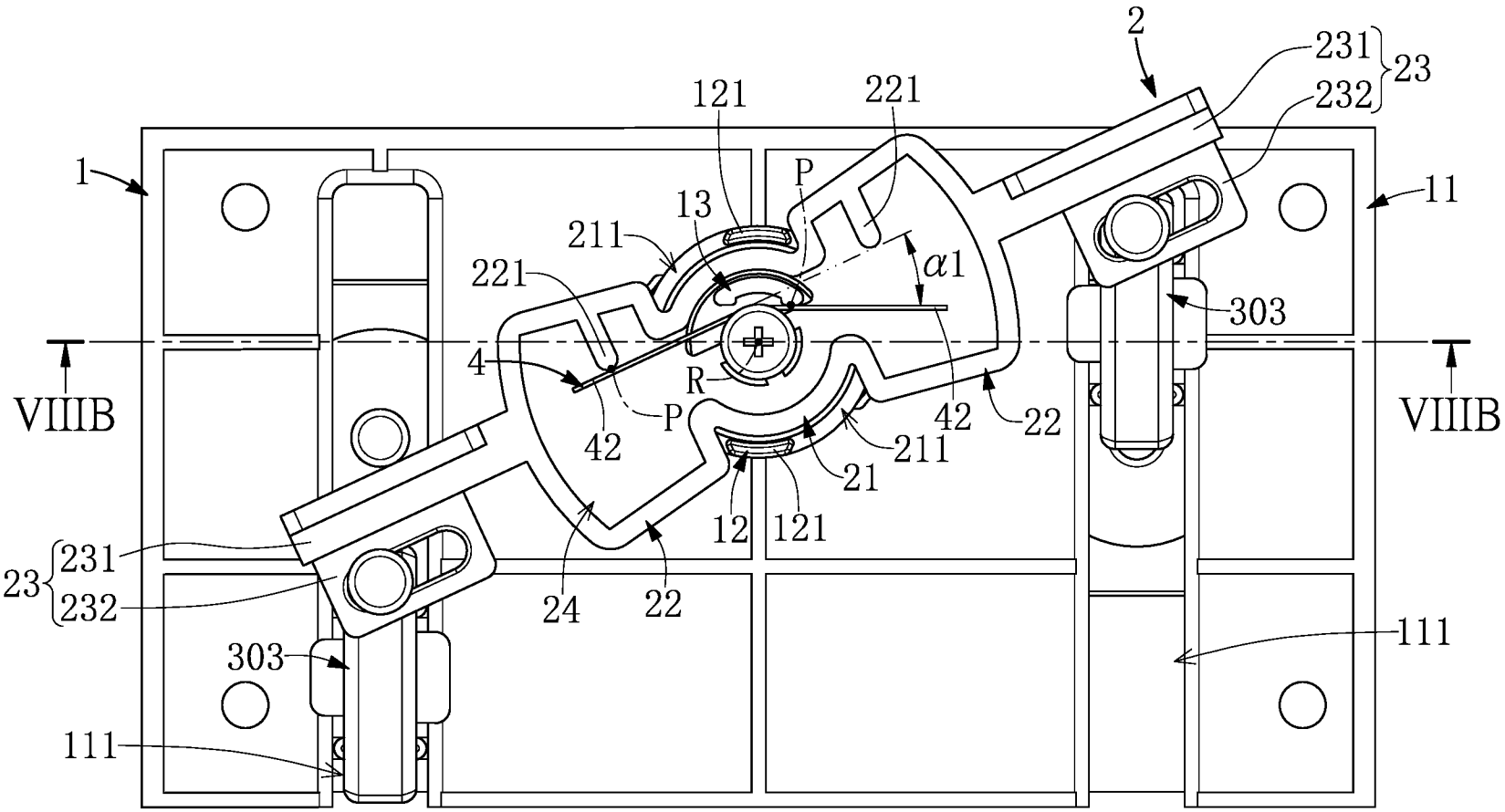
FIG. 8A is a top view of FIG. 2 when the antenna board, the heatsink, and the housing are omitted.
Figure 8B:
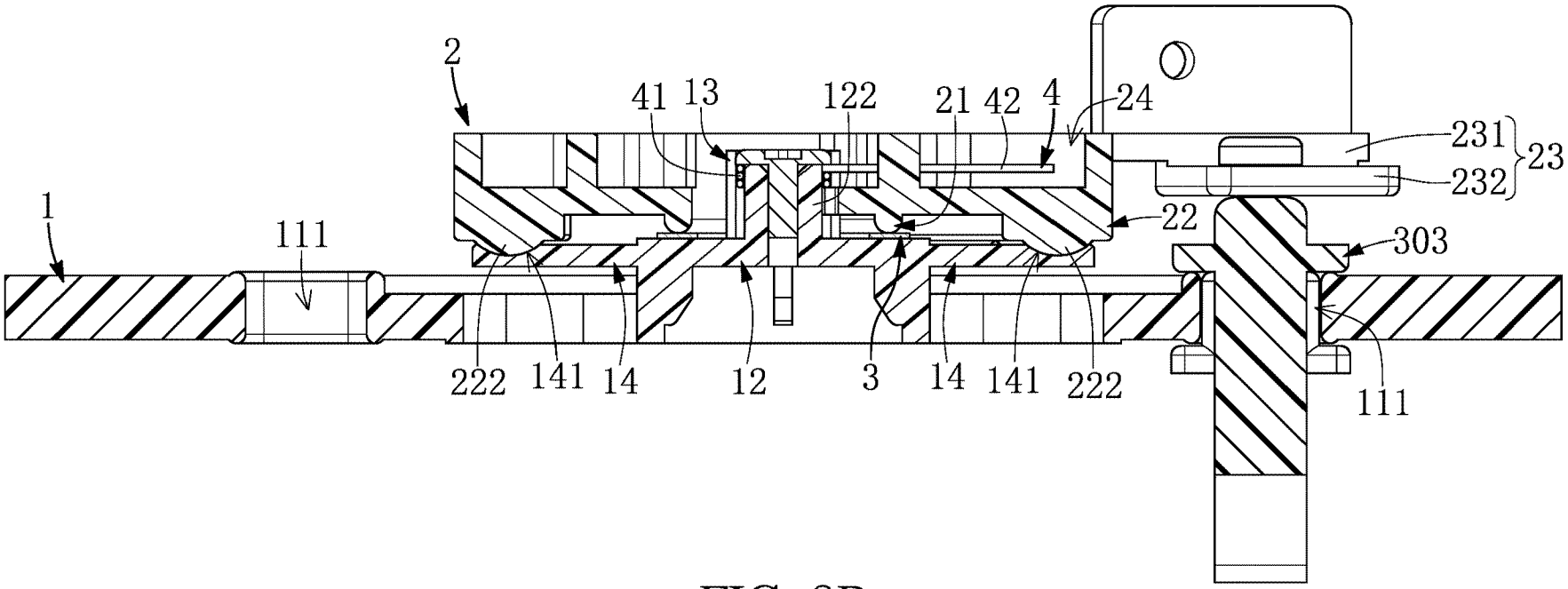
FIG. 8B is a cross-sectional view taken along line VIIIB-VIIIB of FIG. 8A.
Figure 9A:
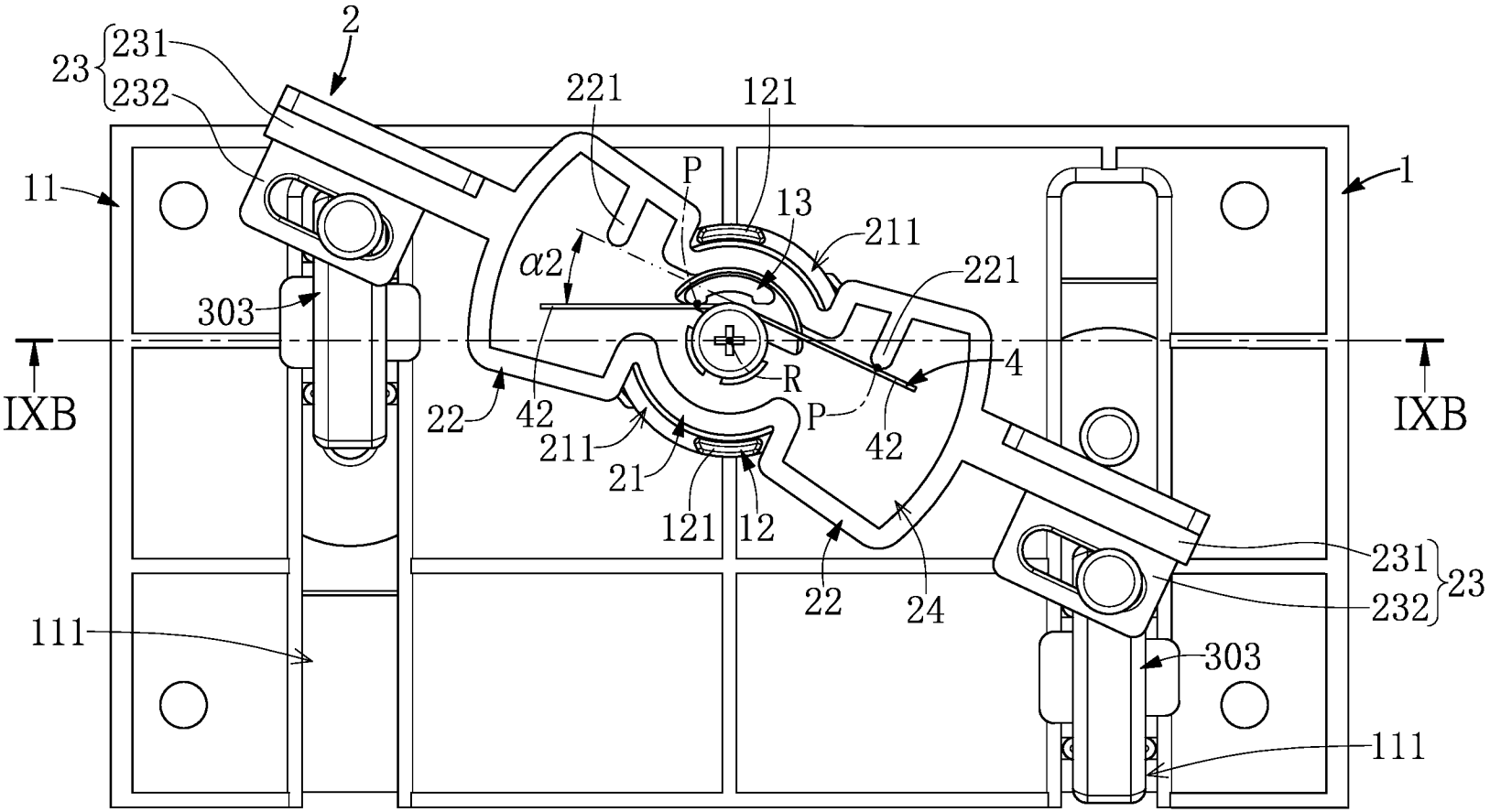
FIG. 9A is a top view of FIG. 3 when the antenna board, the heatsink, and the housing are omitted.
Figure 9B:
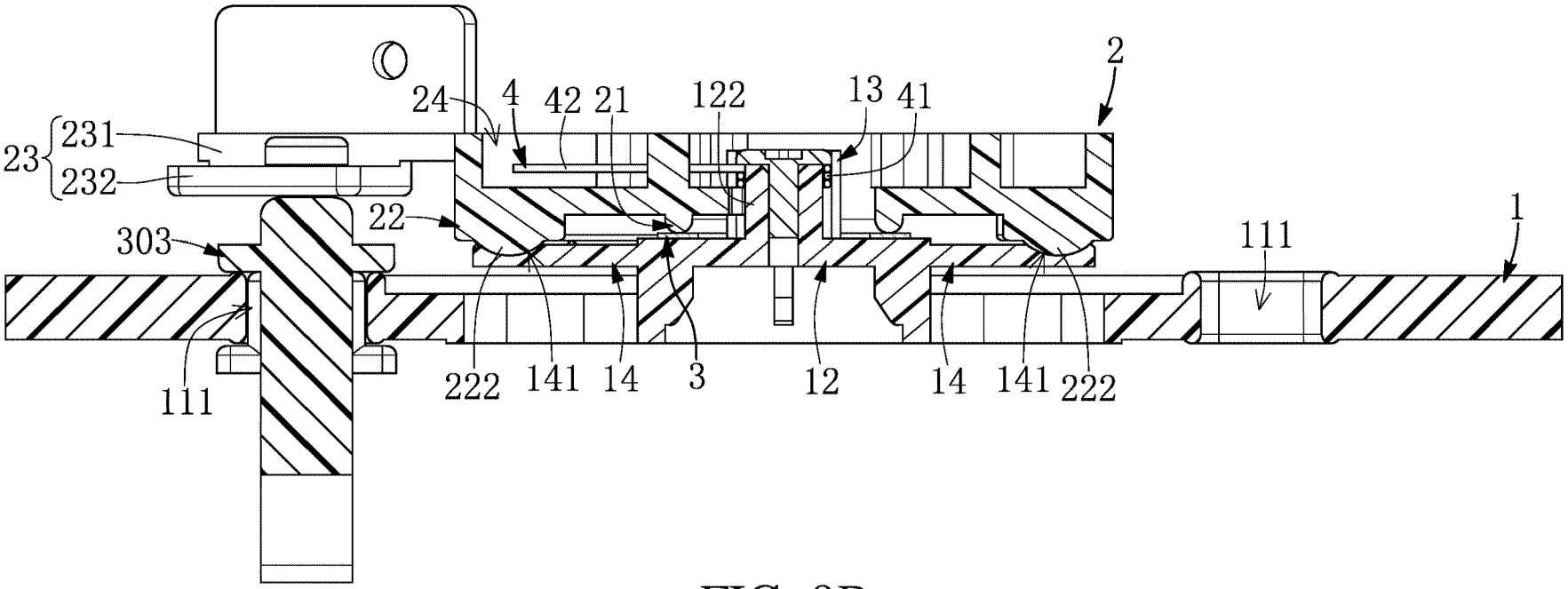
FIG. 9B is a cross-sectional view taken along line IXB-IXB of FIG. 9A.

As shown in FIG. 8A and FIG. 9A, in the present embodiment, the first predetermined angle α1 is within a range from 0 to 45degrees (e.g., 0 to 30 degrees), the second predetermined angle α2 is within a range from 0 to 45 degrees (e.g., 0 to 30 degrees), and a difference between the first predetermined angle al and the second predetermined angle α2 is less than or equal to 5 degrees (e.g., the difference can be 0).

As shown in FIG. 5 to FIG. 7, in the present embodiment, the rotation carrier 2 is an inherently one-piece structure, and the rotation carrier 2 includes a pivoting segment 21, two lateral wing segments 22 extending from the pivoting segment 21 along directions away from each other, respectively, and two connection segments 23 that respectively extend from the two lateral wing segments 22. An outer contour jointly defined by the pivoting segment 21 and the two lateral wing segments 22 is similar to a contour of a bow tie. An inner side of the pivoting segment 21 and inner sides of the two lateral wing segments 22 jointly define an accommodating slot 23, and each of two opposite outer sides of the pivoting segment 21 has a limiting groove 211 between the two lateral wing segments 22.

Moreover, the rotation carrier 2 is rotatably disposed on the stage 12 of the holder 1. The rotation carrier 2 is assembled to the stage 12 by using the pivoting segment 21 to be pivotally connected to the assembling pillar 122 along the rotation axis R, and the gasket 3 is sandwiched between the pivoting segment 21 and the stage 12, so that the gasket 3 can be used to effectively reduce friction generated from the rotation of the rotation carrier 2. In addition, the two lateral wing segments 22 respectively face toward the two cantilevers 14.

The two protruding sheets 121 of the stage 12 are respectively located in the two limiting grooves 211, and the limiting portion 13 is located in the accommodating slot 24 by passing through the pivoting segment 21. Each of the two lateral wing segments 22 has an abutting portion 221 arranged in the accommodating slot 24, and the abutting portions 221 of the two lateral wing segments 22 are respectively located at two opposite sides of the limiting portion 13.

Specifically, a bottom of each of the two lateral wing segments 22 of the rotation carrier 2 has two mating portions 222 (e.g., protrusions), and any one of the mating portions 222 is able to be engaged with the positioning portion 141 of the corresponding cantilever 14. The rotation carrier 2 is retained at the first position (shown in FIG. 8A and FIG. 8B) by having one of the two mating portions 222 of any one of the two lateral wing segments 22 engaged with the positioning portion 141, and the rotation carrier 2 is retained at the second position (shown in FIG. 9A and FIG. 9B) by having another one of the two mating portions 222 of any one of the two lateral wing segments 22 engaged with the positioning portion 141.

It should be noted that each of the two lateral wing segments 22 in the present embodiment is provided with the two mating portions 222, but the present disclosure is not limited thereto. For example, in other embodiments of the present disclosure not shown in the drawings, the rotation carrier 2 can be provided without any one of the mating portions 222; or, the rotation carrier 2 is provided with the mating portions 222 that are only formed on one of the two lateral wing segments 22; or, at least one of the two lateral wing segments 22 further has a central mating portion between the two mating portions 222 thereof, so that the rotation carrier 2 can be retained at the initial position by having the central mating portion engaged with the positioning portion 141 of the corresponding cantilever 14.

The torsion spring 4 in the present embodiment is formed by winding a single metal wire, and the torsion spring 4 includes an elastic portion 41 being in a spiral shape and two extending arms 42 that respectively extend from two ends of the elastic portion 41. The elastic portion 41 of the torsion spring 4 is disposed on the holder 1. In the present embodiment, the elastic portion 41 is sleeved around and limited by the assembling pillar 122 (e.g., a screw fastened to the assembling pillar 122 is used to limit the elastic portion 41), and the two extending arms 42 abut against the limiting portion 13 and respectively abut against the two abutting portions 221.

Specifically, the two ends of the elastic portion 41 are located adjacent to the limiting portion 13, and the torsion spring 4 is configured to store a prepressing force by the two extending arms 42 abutting against the limiting portion 13 and respectively abutting against the two abutting portions 221. In the present embodiment, when the rotation carrier 2 is at the initial position (shown in FIG. 7), the two extending arms 42 abut against a plurality of contact points P of the limiting portion 13 and the two abutting portions 221, and the contact points P are arranged in one row along a straight direction, but the present disclosure is not limited thereto.

As shown in FIG. 7, FIG. 8A, and FIG. 9A, when the rotation carrier 2 is rotated from the initial position, one of the two extending arms 42 is moved by the corresponding abutting portion 221 so as to be separated from the limiting portion 13, and another one of the two extending arms 42 is separate from the corresponding abutting portion 221 and remains abutting against the limiting portion 13.

Specifically, when the rotation carrier 2 is rotated from the initial position (shown in FIG. 7) by the first predetermined angle α1 (shown in FIG. 8A) or the second predetermined angle α2 (shown in FIG. 9A), the rotation carrier 2 presses and moves one of the two extending arms 42, and another one of the two extending arms 42 abuts against the limiting portion 13, so that the elastic portion 41 is deformed to store an elastic force that tends to move the rotation carrier 2 toward the initial position and that is greater than the prepressing force.

In addition, as shown in FIG. 5 and FIG. 6, each of the two connection segments 23 of the rotation carrier 2 in the present embodiment includes a first assembling portion 231 and a second assembling portion 232 that is connected to the first assembling portion 231. In each of the two connection segments 23, the first assembling portion 231 is in an L-shaped structure and is connected to a top side of the corresponding lateral wing segment 22, and the second assembling portion 232 is connected to a bottom side of the first assembling portion 231 and is parallel to the board 11.

As shown in FIG. 1 to FIG. 4, the antenna board 200 is assembled to the rotation carrier 2, and the antenna board 200 is assembled to the rotation carrier 2 along the rotation axis R (e.g., the antenna board 200 is fixed to the first assembling portions 231 of the two connection segments 23 and is located above the pivoting segment 21 and the two lateral wing segments 22), so that the rotation axis R passes through the antenna board 200 and is perpendicular to a normal vector of the antenna board 200, but the present disclosure is not limited thereto. For example, in other embodiments of the present disclosure not shown in the drawings, the antenna board 200 can be assembled to the rotation carrier 2 in a manner that is non-perpendicular to the rotation axis R according to design requirements.

Accordingly, the antenna board 200 in the present embodiment can be rotated with the rotation carrier 2 to different positions through the orientation adjustment mechanism 100, so that a main beam direction of the antenna board 200 can be changed or adjusted in the antenna device 1000, thereby satisfying wider use requirements (e.g., the antenna device 1000 can be avoided reducing the applicability after being fastened at a specific position) and being suitable to be applied to more environments.

It should be noted that the housing 500 of the antenna device 1000 is preferably symmetrical to the rotation axis R, so that when the antenna board 200 is rotated with the rotation carrier 2 to different positions, portions of the housing 500 facing the antenna board 200 have substantially same structure. Accordingly, the operation of the antenna board 200 affected by the housing 500 can be reduced.

Figure 11:
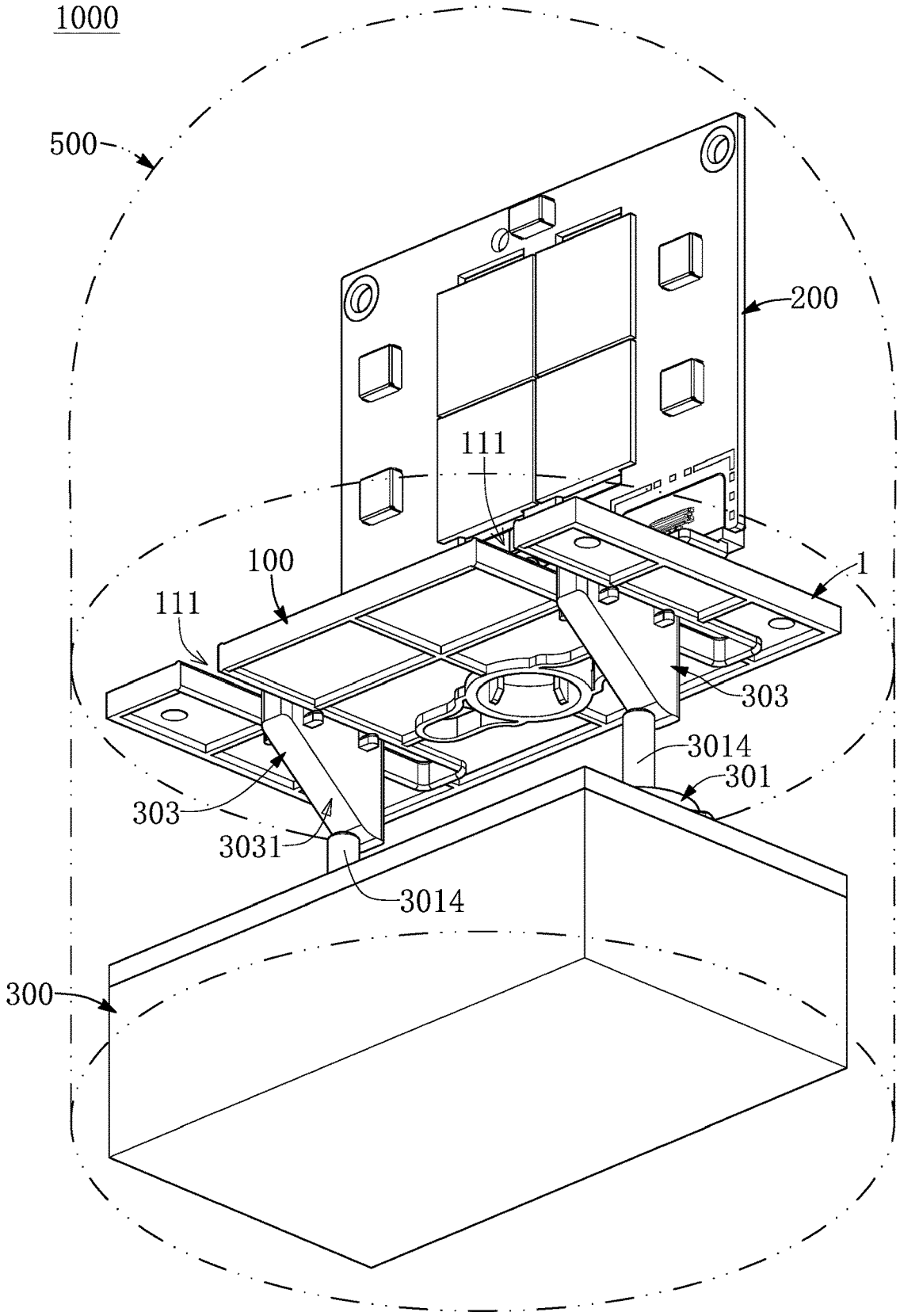
FIG. 11 is a perspective view of FIG. 1 from another angle of view.

As shown in FIG. 1 and FIG. 11, the driving module 300 corresponds in position to the rotation carrier 2 and is configured to drive the rotation carrier 2 to be rotated. In the present embodiment, the driving module 300 can drive the rotation carrier 2 to be rotated and retained at the first position or the second position, and the elastic force is sufficient to drive the positioning portion 141 and a corresponding one of the mating portions 222 (shown in FIG. 8B and FIG. 9B) to be separated from each other, thereby moving the rotation carrier 2 to the initial position, but the present disclosure is not limited thereto.

Figure 2:
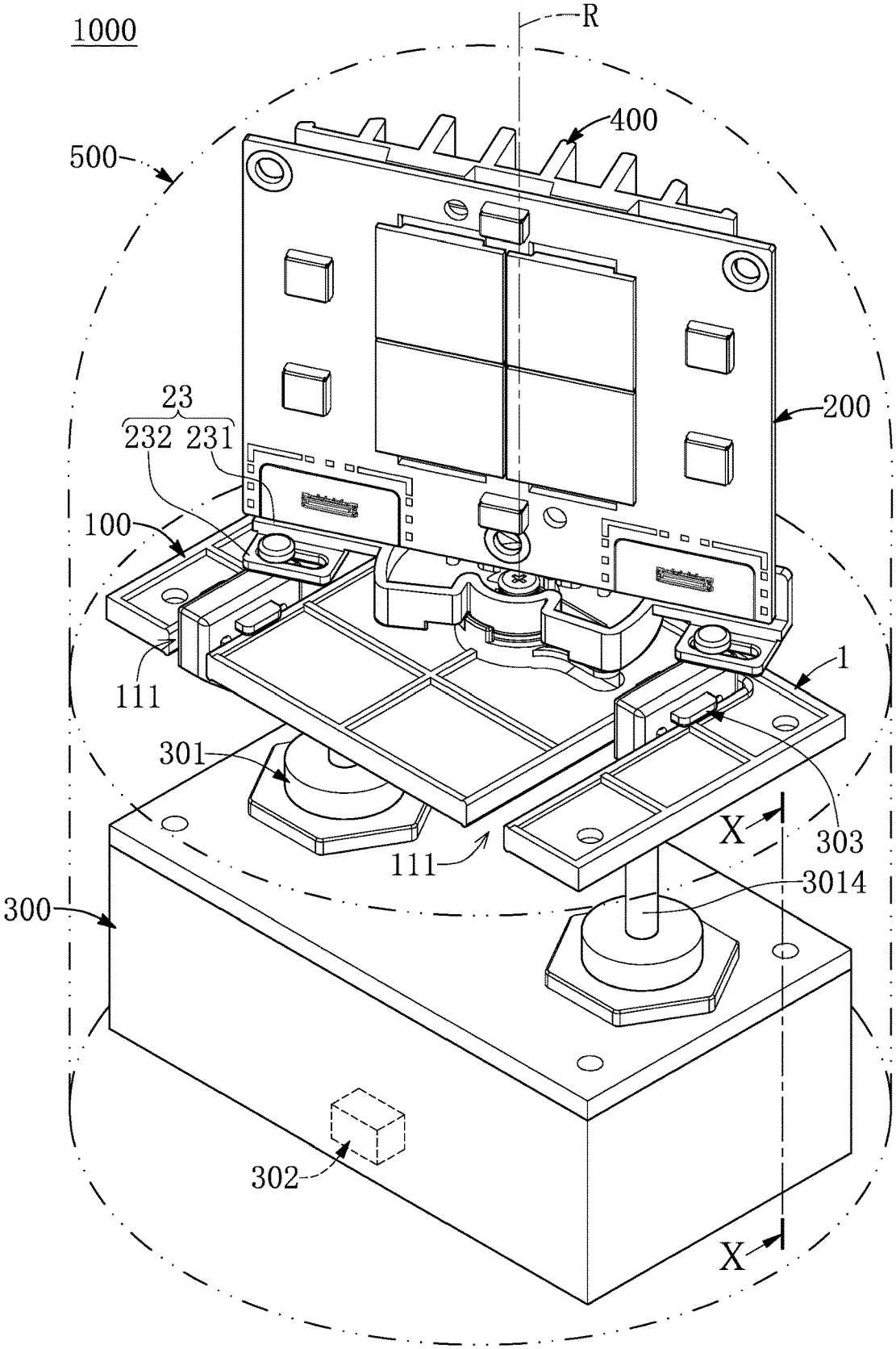
FIG. 2 is a perspective view showing the antenna device of FIG. 1 when a rotation carrier thereof is at a first position.
Figure 3:
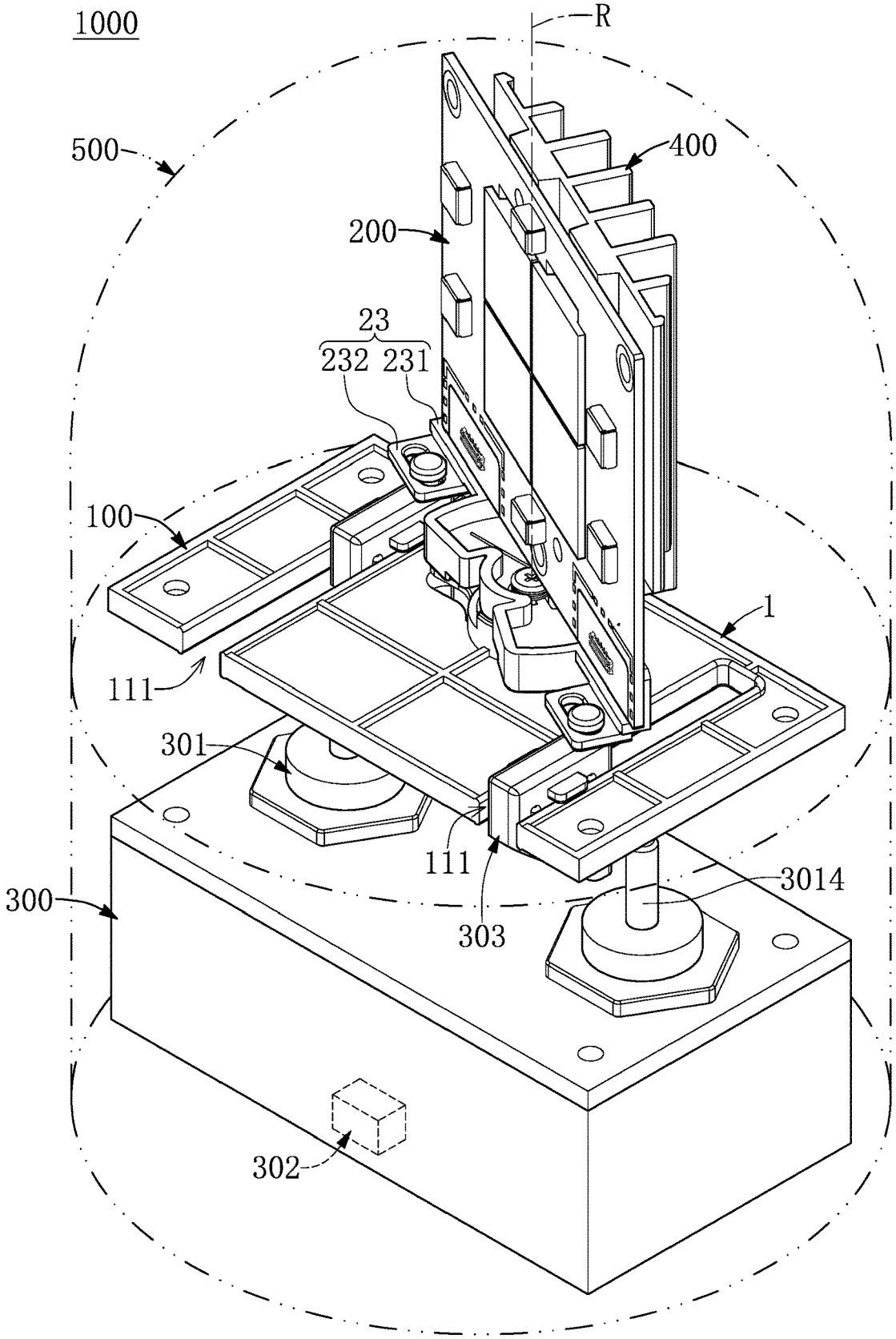
FIG. 3 is a perspective view showing the antenna device of FIG. 1 when the rotation carrier is at a second position.
Figure 4:
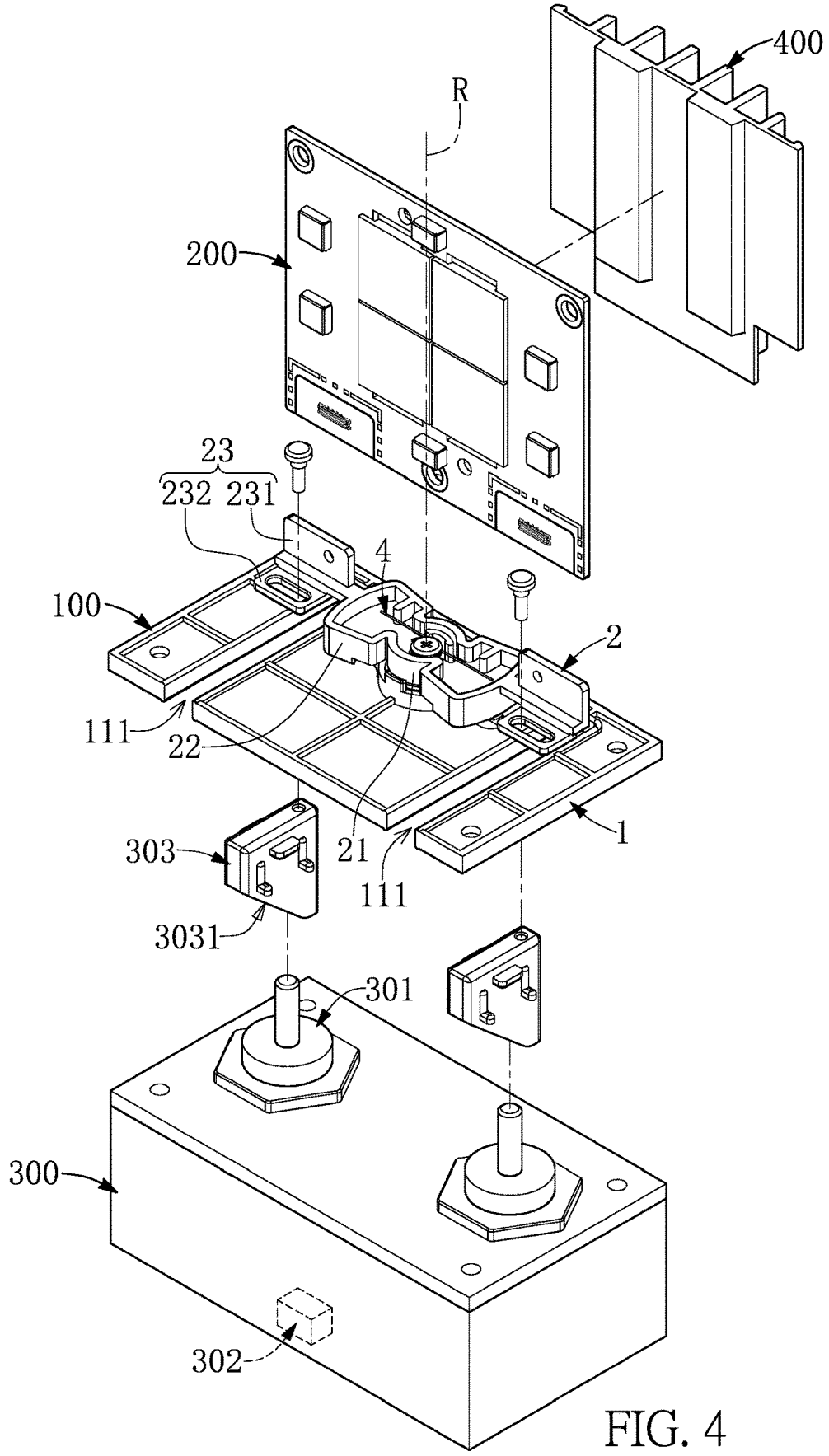
FIG. 4 is an exploded view of FIG. 1.

As shown in FIG. 1 to FIG. 3, the rotation carrier 2 in the present embodiment at the first position or the second position can be remained by the driving module 300, and is not remained by the positioning portion 141 and a corresponding one of the mating portions 222 (shown in FIG. 8B and FIG. 9B), but the present disclosure is not limited thereto. For example, in other embodiments of the present disclosure not shown in the drawings, the driving module 300 can be just used to rotate the rotation carrier 2 to the first position or the second position, and then at least one of the mating portions 222 of the rotation carrier 2 is engaged with the corresponding positioning portion 141 so as to be retained at the first position or the second position. Moreover, the elastic force is just used to move the rotation carrier 2 to the initial position, after the at least one of the mating portions 222 of the rotation carrier 2 is separate from the corresponding positioning portion 141.

In summary, as shown in FIG. 1 to FIG. 7, the orientation adjustment mechanism 100 in the present embodiment can be used to allow the rotation carrier 2 to be precisely rotated to the initial position by the structural cooperation of the torsion spring 4 and some components (e.g., the limiting portion 13 and/or the two abutting portions 221), so that an orientation of the antenna board 200 can be precisely controlled by the orientation adjustment mechanism 100.

Figure 10:
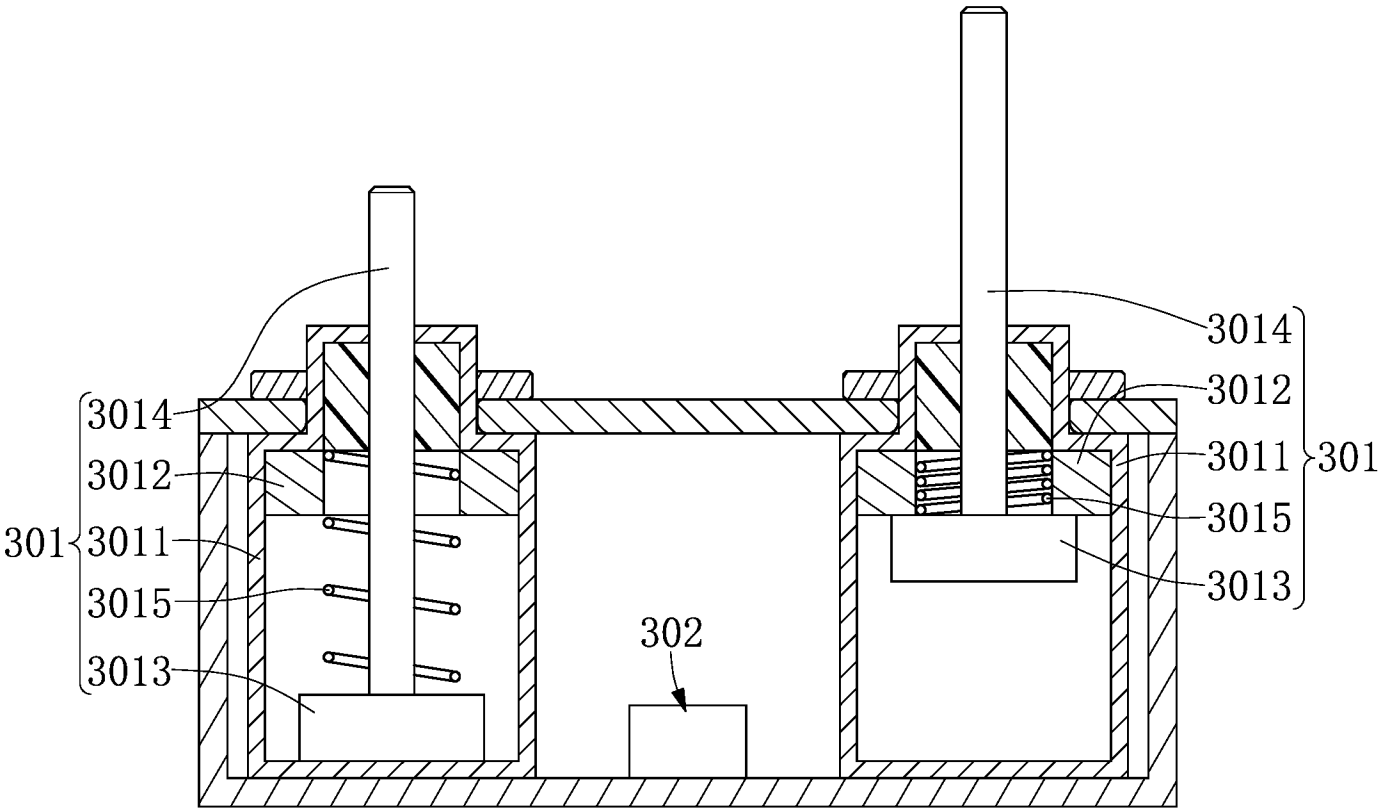
FIG. 10 is a cross-sectional view taken along line X-X of FIG. 2 and shows two electromagnets of FIG. 2.

As shown in FIG. 10 and FIG. 11, the driving module 300 in the present embodiment includes two electromagnets 301, a controller 302 electrically coupled to the two electromagnets 301, and two sliders 303 that respectively correspond in position to the two electromagnets 301. The controller 302 can be independently controlled and drive any one of the two electromagnets 301 to be selectively in a protruding mode (e.g., the electromagnet 301 at the right side of FIG. 10) or a retracted mode (e.g., the electromagnet 301 at the left side of FIG. 10).

Specifically, the following description simply describes one possible structure of the electromagnet 301, and describes the electromagnet 301 in the protruding mode for clearly defining the connection relationship of components of the electromagnet 301. As shown in FIG. 10, the electromagnet 301 includes a frame 3011, a permanent magnet 3012 disposed on one end of the frame 3011, an electromagnetic coil 3013 located at another end of the frame 3011, a metal core 3014 connected to the electromagnetic coil 3013 and passing through the permanent magnet 3012, and a spring 3015 that is arranged in the frame 3011 and that is wound around the metal core 3014.

Moreover, as shown in FIG. 10, when the electromagnetic coil 3013 receives a current by the controller 302 to form a magnetic field, the electromagnetic coil 3013 is driven by the magnetic field to move toward and to magnetically attracted with the permanent magnet 3012, the metal core 3014 is synchronously moved to result that a free end thereof is located away from the permanent magnet 3012 and protrudes from the frame 3011, and the spring 3015 is compressed, thereby causing the electromagnet 301 to be in the protruding mode. After that, when the current stops to supply to the electromagnetic coil 3013, since the permanent magnet 3012 is magnetically attracted with the corresponding component (e.g., the electromagnetic coil 3013), the electromagnet 301 can be remained in the protruding mode.

In addition, when the electromagnet 301 is in the protruding mode and the electromagnetic coil 3013 receives a reverse current by the controller 302, the electromagnetic coil 3013 is moved to be located away from the permanent magnet 3012, and the metal core 3014 is synchronously moved to retract in the frame 3011, thereby causing the electromagnet 301 to be changed in the retracted mode. After that, when the reverse current stops to supply to the electromagnetic coil 3013, since the spring 3015 can press the corresponding component (e.g., the electromagnetic coil 3013), the electromagnet 301 can be remained in the retracted mode.

In the present embodiment, as shown in FIG. 1 and FIG. 11, the two sliders 303 are slidably arranged in the two track grooves 111 of the holder 1, respectively, and the two sliders 303 are respectively connected to two opposite ends of the rotation carrier 2 (e.g., the two sliders 303 are respectively interlinked with the second assembling portions 232 of the two connection segments 23). The two electromagnets 301 respectively correspond in position to the two opposite ends of the rotation carrier 2 (e.g., the two connection segments 23), and the two electromagnets 301 respectively correspond in position to the two sliders, so that each of the two electromagnets 301 can be configured to rotate the rotation carrier 2 by moving the corresponding slider 303 .

Figure 12:
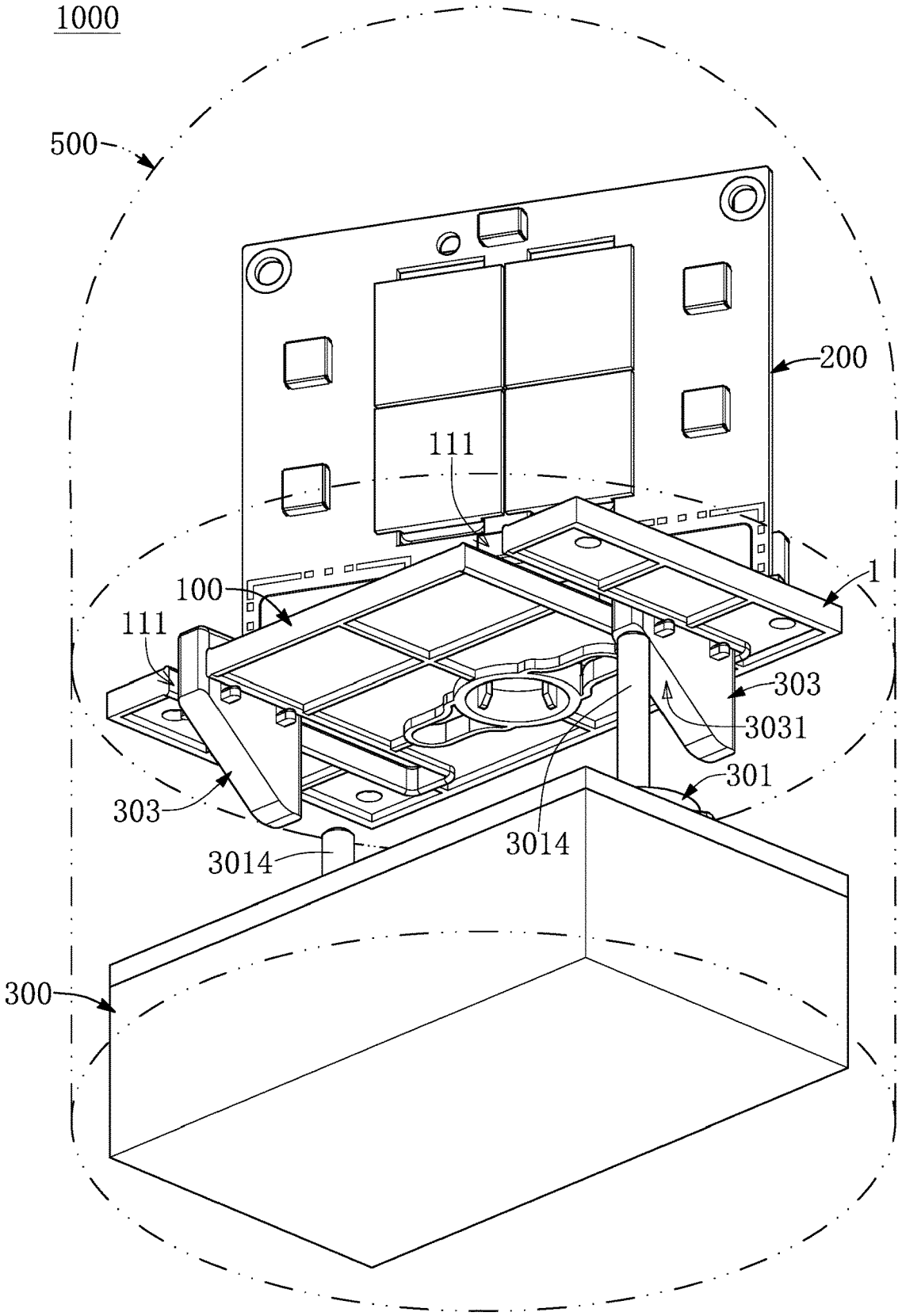
FIG. 12 is a perspective view of FIG. 2 from another angle of view.

In order to clearly describe the present embodiment, the following description just describes the connection relationship between any one of the two electromagnets 301 and the corresponding slider 303. The slider 303 has a guiding surface 3031, and the metal core 3014 of the electromagnet 301 faces toward the guiding surface 3031 of the slider 303. As shown in FIG. 1 and FIG. 11, when the electromagnet 301 is in the retracted mode, the metal core 3014 faces toward or contacts a bottom side of the guiding surface 3031. As shown in FIG. 2 and FIG. 12, when the electromagnet 301 is changed from the retracted mode to the protruding mode, the metal core 3014 presses the guiding surface 3031 to move the slider 303 along the track groove 111, so that the slider 303 can move the corresponding connection segment 23 for implementing the rotation of the rotation carrier 2.

Figure 13:
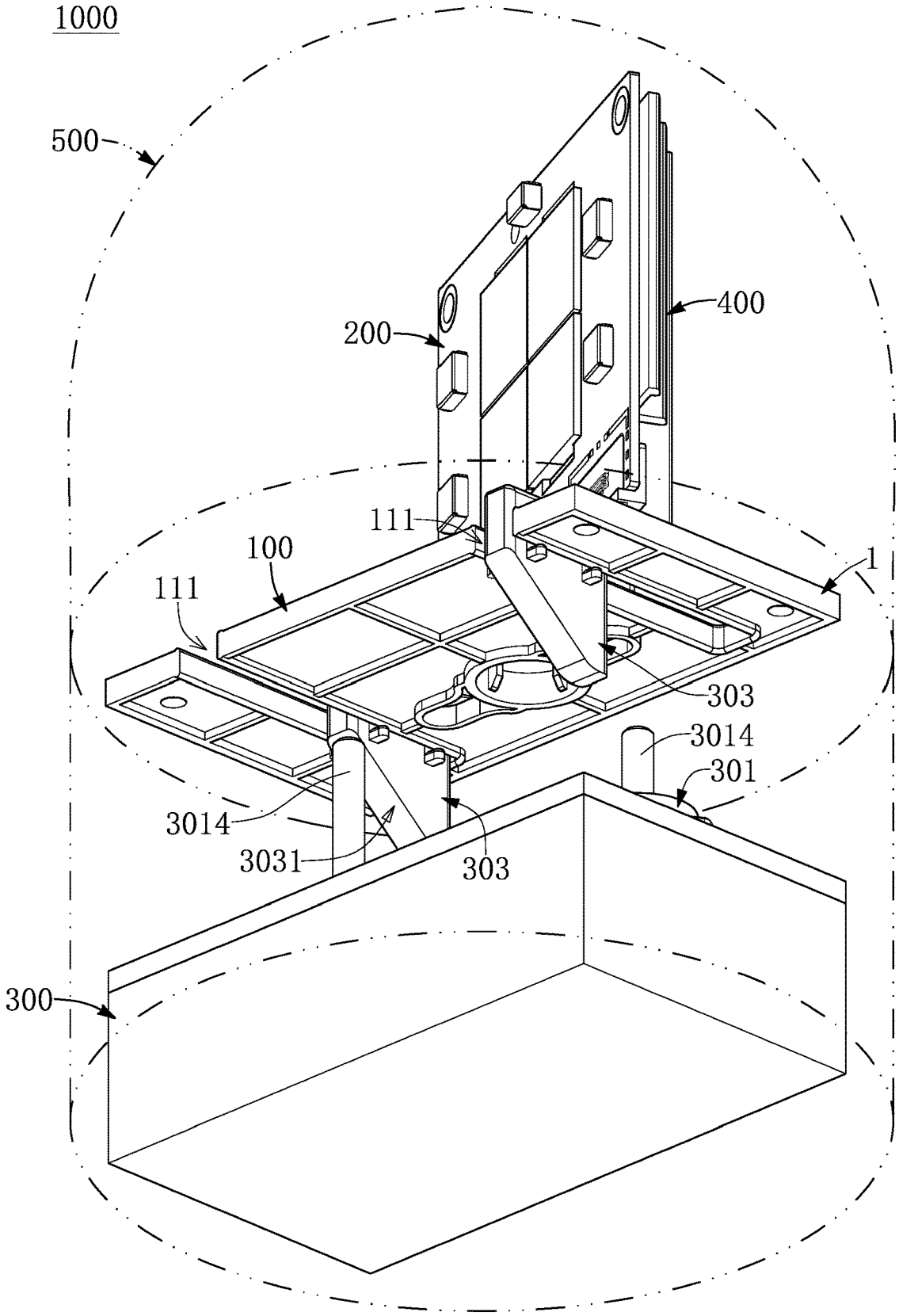
FIG. 13 is a perspective view of FIG. 3 from another angle of view.

Accordingly, the rotation carrier 2 can be driven by one of the two electromagnets 301 (and the corresponding slider 303) to be rotated and retained at the first position (shown in FIG. 2 and FIG. 12), and can be driven by another one of the two electromagnets 301 (and the corresponding slider 303) to be rotated and retained at the second position (shown in FIG. 3 and FIG. 13).

It should be noted that the rotation carrier 2 in the present embodiment is described in cooperation with the driving module 300 so as to be rotated and retained at the first position or the second position, but the present disclosure is not limited thereto.

In addition, each of the two electromagnets 301 of the driving module 300 in the present embodiment is described in cooperation with one of the two sliders 303, but the present disclosure is not limited thereto. For example, in other embodiments of the present disclosure not shown in the drawings, the driving module 300 can only include the two electromagnets 301 without any one of the sliders 303, and the driving module 300 can directly move the rotation carrier 2 (e.g., the corresponding connection segment 23) by one of the two electromagnets 301 so as to rotate the rotation carrier 2 to the first position or the second position; or, the driving module 300 can rotate the rotation carrier 2 by using other components different from the electromagnet 301.

[Beneficial Effects of the Embodiment]

In conclusion, the antenna board in the present disclosure can be rotated with the rotation carrier to different positions through the orientation adjustment mechanism, so that a main beam direction of the antenna board can be changed or adjusted in the antenna device, thereby satisfying wider use requirements (e.g., the antenna device can be avoided reducing the applicability after being fastened at a specific position) and being suitable to be applied to more environments.

Moreover, the orientation adjustment mechanism in the present disclosure can be used to allow the rotation carrier to be precisely rotated to the initial position by the structural cooperation of the torsion spring and some components (e.g., the limiting portion and/or the two abutting portions), so that an orientation of the antenna board can be precisely controlled by the orientation adjustment mechanism.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An antenna device, comprising:

an orientation adjustment mechanism including:

a holder having a limiting portion;

a rotation carrier assembled to the holder and being rotatable along a rotation axis relative to the holder, wherein the rotation carrier is rotatable in a counterclockwise direction from an initial position by a first predetermined angle to be retained at a first position or is rotatable in a clockwise direction from the initial position by a second predetermined angle to be retained at a second position; and a torsion spring having an elastic portion disposed on the holder and two extending arms that extend from the elastic portion;

wherein, when the rotation carrier is rotated from the initial position by the first predetermined angle or the second predetermined angle, the rotation carrier presses and moves one of the two extending arms, and another one of the two extending arms abuts against the limiting portion, so that the elastic portion is deformed to store an elastic force that tends to move the rotation carrier toward the initial position;

an antenna board assembled to the rotation carrier and being non-perpendicular to the rotation axis; and a driving module corresponding in position to the rotation carrier and configured to drive the rotation carrier to be rotated.

2. The antenna device according to claim 1, wherein the holder has a positioning portion, the rotation carrier has two mating portions, and any one of the mating portions is able to be engaged with the positioning portion, and wherein the rotation carrier is retained at the first position by having one of the two mating portions engaged with the positioning portion, and the rotation carrier is retained at the second position by having another one of the two mating portions engaged with the positioning portion.

3. The antenna device according to claim 2, wherein the driving module includes two electromagnets respectively corresponding in position to two opposite ends of the rotation carrier, and wherein the rotation carrier is configured to be rotated by one of the two electromagnets so as to be retained at the first position or by another one of the two electromagnets so as to be retained at the second position.

4. The antenna device according to claim 3, wherein the driving module further includes two sliders respectively connected to the two opposite ends of the rotation carrier, and wherein the two electromagnets respectively correspond in position to the two sliders, and each of the two electromagnets is configured to rotate the rotation carrier by moving the corresponding slider.

5. The antenna device according to claim 1, wherein the rotation carrier has two abutting portions respectively located at two opposite sides of the limiting portion, and the two extending arms abut against the limiting portion and respectively abut against the two abutting portions, and wherein, when the rotation carrier is rotated from the initial position, one of the two extending arms is moved by the corresponding abutting portion so as to be separated from the limiting portion, and another one of the two extending arms is separate from the corresponding abutting portion and remains abutting against the limiting portion.

6. The antenna device according to claim 5, wherein the torsion spring is configured to store a prepressing force less than the elastic force by the two extending arms abutting against the limiting portion and respectively abutting against the two abutting portions.

7. The antenna device according to claim 5, wherein the two extending arms abut against a plurality of contact points of the limiting portion and the two abutting portions, and the contact points are arranged in one row along a straight direction.

8. The antenna device according to claim 1, wherein the first predetermined angle is within a range from 0 to 45 degrees, the second predetermined angle is within a range from 0 to 45 degrees, and a difference between the first predetermined angle and the second predetermined angle is less than or equal to 5 degrees.

9. The antenna device according to claim 1, wherein the antenna board is assembled to the rotation carrier along the rotation axis, so that the rotation axis passes through the antenna board and is perpendicular to a normal vector of the antenna board.

10. An orientation adjustment mechanism, comprising:

a holder having a limiting portion;

a rotation carrier assembled to the holder and being rotatable along a rotation axis relative to the holder, wherein the rotation carrier is rotatable in a counter-clockwise direction from an initial position by a first predetermined angle to be retained at a first position or is rotatable in a clockwise direction from the initial position by a second predetermined angle to be retained at a second position; and a torsion spring having an elastic portion disposed on the holder and two extending arms that extend from the elastic portion;

wherein, when the rotation carrier is rotated from the initial position by the first predetermined angle or the second predetermined angle, the rotation carrier presses and moves one of the two extending arms, and another one of the two extending arms abuts against the limiting portion, so that the elastic portion is deformed to store an elastic force that tends to move the rotation carrier toward the initial position.

11. The orientation adjustment mechanism according to claim 10, wherein the holder has a cantilever having a positioning portion arranged on a free end thereof, the rotation carrier has two mating portions, and any one of the mating portions is able to be engaged with the positioning portion, and wherein the rotation carrier is retained at the first position by having one of the two mating portions engaged with the positioning portion, and the rotation carrier is retained at the second position by having another one of the two mating portions engaged with the positioning portion.

12. The orientation adjustment mechanism according to claim 10, wherein the rotation carrier has two abutting portions respectively located at two opposite sides of the limiting portion, and the two extending arms abut against the limiting portion and respectively abut against the two abutting portions, and wherein, when the rotation carrier is rotated from the initial position, one of the two extending arms is moved by the corresponding abutting portion so as to be separated from the limiting portion, and another one of the two extending arms is separate from the corresponding abutting portion and remains abutting against the limiting portion.

13. The orientation adjustment mechanism according to claim 12, wherein the torsion spring is configured to store a prepressing force less than the elastic force by the two extending arms abutting against the limiting portion and respectively abutting against the two abutting portions, and wherein the two extending arms abut against a plurality of contact points of the limiting portion and the two abutting portions, and the contact points are arranged in one row along a straight direction.

14. The orientation adjustment mechanism according to claim 10, wherein the first predetermined angle is within a range from 0 to 45 degrees, the second predetermined angle is within a range from 0 to 45 degrees, and a difference between the first predetermined angle and the second predetermined angle is less than or equal to 5 degrees.

* * * * *